US007651322B2

(12) United States Patent
Shaw

(10) Patent No.: US 7,651,322 B2
(45) Date of Patent: Jan. 26, 2010

(54) OIL BALANCE SYSTEM AND METHOD FOR COMPRESSORS CONNECTED IN SERIES

(75) Inventor: David N. Shaw, East Falmouth, MA (US)

(73) Assignee: Hallowell International, LLC, Bangor, ME (US)

( * ) Notice: Subject to any disclaimer, the term of this patent is extended or adjusted under 35 U.S.C. 154(b) by 222 days.

(21) Appl. No.: 11/952,366

(22) Filed: Dec. 7, 2007

(65) Prior Publication Data

US 2008/0085195 A1 Apr. 10, 2008

Related U.S. Application Data

(63) Continuation of application No. 10/959,254, filed on Oct. 6, 2004, now abandoned.

(51) Int. Cl.
*F04B 39/04* (2006.01)
*F25B 43/02* (2006.01)

(52) U.S. Cl. ..... 417/228; 417/902; 62/84; 62/193

(58) Field of Classification Search ..... 417/228, 417/244, 902; 62/84, 192, 193, 468–470, 62/508, 510

See application file for complete search history.

(56) References Cited

U.S. PATENT DOCUMENTS 2,076,332 A 4/1937 Zercher
2,243,541 A 5/1941 Swart
2,352,581 A 6/1944 Winkler
2,646,212 A * 7/1953 Kellie ..... 417/228
2,663,164 A 12/1953 Kurtz (Continued)

FOREIGN PATENT DOCUMENTS

EP 0 106 414 4/1984

(Continued)

OTHER PUBLICATIONS

Shaw, David. "Oil Balance System and Method for Compressors," U.S. Appl. No. 11/664,956 filed Apr. 6, 2007, Specification having 18 pages, Figures having 5 sheets.

(Continued)

*Primary Examiner*—Charles G Freay
(74) *Attorney, Agent, or Firm*—Cantor Colburn LLP

(57) ABSTRACT

A compressor system includes a first compressor, which has a first low side oil sump, in a first shell and a second compressor, which has a second low side oil sump, in a second shell. The first and second compressors are connected in series. There is an oil transfer conduit connected between the first low side sump of the first compressor and the second low side sump of the second compressor. The system also includes a normally open check valve in the oil transfer conduit. A method for effecting oil balance in a compressor system, the method includes establishing a first compressor in a first shell having a first low side oil sump and establishing a second compressor in a second shell having a second low side oil sump. The first and second compressors are connected in series. The method also includes positioning an oil transfer conduit between the first low side sump and the second low side sump and positioning a normally open check valve in the oil transfer conduit.

19 Claims, 1 Drawing Sheet

U.S. PATENT DOCUMENTS

| | | | | |
|---|---|---|---|---|
| 2,938,361 | A | | 5/1960 | McNatt |
| 3,072,318 | A | | 1/1963 | Berger et al. |
| 3,074,249 | A | | 1/1963 | Henderson |
| 3,226,949 | A | | 1/1966 | Gamache |
| 3,237,852 | A | | 3/1966 | Shaw |
| 3,241,746 | A | | 3/1966 | Shaw |
| 3,243,101 | A | | 3/1966 | Shaw |
| 3,465,953 | A | | 9/1966 | Shaw |
| 3,377,816 | A | | 4/1968 | Berger |
| 3,500,962 | A | | 3/1970 | Kocher |
| 3,543,880 | A | | 12/1970 | Scott |
| 3,719,057 | A | | 3/1973 | Grant |
| 3,775,995 | A | | 12/1973 | Conley et al. |
| 3,785,169 | A | | 1/1974 | Gylland, Jr. |
| 3,852,974 | A | | 12/1974 | Brown |
| 3,859,815 | A | | 1/1975 | Kasahara |
| 3,984,050 | A | | 10/1976 | Gustafsson |
| 4,180,236 | A | | 12/1979 | Saarem et al. |
| 4,197,719 | A | | 4/1980 | Shaw |
| 4,205,537 | A | | 6/1980 | Dubberley |
| 4,236,876 | A | | 12/1980 | Fraser et al. |
| 4,268,291 | A | | 5/1981 | Cann |
| 4,306,420 | A | | 12/1981 | Cann |
| 4,332,144 | A | | 6/1982 | Shaw |
| 4,439,121 | A | | 3/1984 | Shaw |
| 4,594,858 | A | | 6/1986 | Shaw |
| 4,748,820 | A | | 6/1988 | Shaw |
| 4,753,083 | A | | 6/1988 | Sato |
| 4,787,211 | A | | 11/1988 | Shaw |
| 4,833,893 | A | | 5/1989 | Morita |
| 4,870,831 | A | * | 10/1989 | Kitamoto ..... 62/84 |
| 4,947,655 | A | | 8/1990 | Shaw |
| 5,062,274 | A | | 11/1991 | Shaw |
| 5,094,085 | A | | 3/1992 | Irino |
| 5,094,598 | A | | 3/1992 | Amata et al. |
| 5,095,712 | A | | 3/1992 | Narreau |
| 5,123,254 | A | | 6/1992 | Inoue et al. |
| 5,191,776 | A | | 3/1993 | Severance et al. |
| 5,220,806 | A | | 6/1993 | Jaster et al. |
| 5,236,311 | A | * | 8/1993 | Lindstrom ..... 417/254 |
| 5,303,561 | A | | 4/1994 | Bahel et al. |
| 5,410,889 | A | | 5/1995 | Sjoholm et al. |
| 5,626,027 | A | | 5/1997 | Dormer et al. |
| 5,657,637 | A | | 8/1997 | Mertens |
| 5,839,886 | A | | 11/1998 | Shaw |
| 5,894,739 | A | | 4/1999 | Temos |
| 5,927,088 | A | | 7/1999 | Shaw |
| 6,276,148 | B1 | | 8/2001 | Shaw |
| 6,931,871 | B2 | | 8/2005 | Shaw et al. |

FOREIGN PATENT DOCUMENTS

| | | |
|---|---|---|
| EP | 0 715 077 | 6/1996 |
| JP | 57168082 | 10/1982 |
| JP | 58217162 | 12/1983 |
| JP | 59191856 | 10/1984 |
| JP | 6-213170 | 8/1994 |
| WO | WO 97/32168 | 9/1997 |

OTHER PUBLICATIONS

International Search Report with Written Opinion, PCT/US2005/034651, Date Mailed Feb. 26, 2006.

Second Edition- "Application of Thermodynamics"; Author: Bernard D. Wood; 1982 by Bernard D. Wood; 1991 reissued by Waveland Presss, Inc.; pp. 218-222.

A Technical Handbook from SWEP; "Compact Brazed Heat Exchangers for Refrigerant Applications"; 1993; 1 pages plus cover and back sheets.

"Modern Refrigerating Machines"; Author; I. Cerepnalkovski; Elsevier Science Publishers; 1991; pp. 47-48.

"Refrigeration Principles and Systems- An Energy Approach"; Author: Edward G. Pits; Business News Publishing Company; 1991; pp. 243-245.

"Survey and Comparison of Interstage Cooling Systems for Two-Stage Compression"; Data Sheet, No. 20; May 1979; 3 pgs.

"Standard Refrigeration and Air Conditioning Questions & Answers-Third Edition"; Authors: S. M. Elonka and Q.W. Minich; McGraw-Hill, Inc.; 1983, 1973, 1961; pp. 28-31, 50-53.

"Thermal Environment Engineering- Second Edition"; Author: James L. Threlkeld; Prentice-Hall, Inc.; 1970, 1962; pp. 61-70.

"Theory of Mechanical Refrigeration"; Author: N.R. Sparks; McGraw-Hill Book Company, Inc.; 1938; pp. 111-127.

* cited by examiner

OIL BALANCE SYSTEM AND METHOD FOR COMPRESSORS CONNECTED IN SERIES

CROSS REFERENCE TO RELATED APPLICATIONS

The present application is a continuation application under 35 U.S.C. §120 of U.S. patent application Ser. No. 10/959,254 filed on Oct. 6, 2004, the entire contents of which are incorporated herein by reference and priority to which is hereby claimed.

BACKGROUND OF THE INVENTION

This invention relates to an oil balance system for compressors connected in series. More particularly, this invention relates to apparatus and a method for an oil balance system in which each compressor is contained in a separate shell, and in which each oil sump for each compressor is a low side sump, i.e., the inlet to each compressor is open to its respective shell, and the outlet from each compressor is sealed to the compressor.

My prior U.S. Pat. No. 5,839,886, the entire contents of which are incorporated herein by reference, relates to an oil balance system for primary and booster compressors connected in series for a heating/cooling or refrigeration system. The primary compressor has a low side sump, but the booster compressor has a high side sump (i.e., the inlet to the booster compressor is sealed to the compressor, and the outlet from the compressor is open to its shell. An open conduit extends between the oil sumps of the two compressors to transfer oil from the sump of the booster compressor to the sump of the primary compressor when the oil level in the booster compressor exceeds a normal operating level.

My prior U.S. Pat. Nos. 5,927,088 and 6,276,148, the entire contents of both of which are incorporated herein by reference, relate to boosted air source heat pumps especially suitable for cold weather climates. In the systems of these patents, a booster compressor and a primary compressor are connected in series.

Most compressors will entrain and pump out some oil, entrained in the refrigerant, during the normal course of operation. So, for a system of series connected compressors housed in separate casings, the pumped out oil will eventually return to the first compressor in the system, thus tending to raise the oil level in the sump of that compressor. As that oil level rises, this will likely cause the first compressor to pump oil to the inlet to the second compressor, so some oil will be delivered from that first compressor to the second compressor in the system, thus tending to prevent a dangerous loss of lubricant in the second compressor. Various compressor designs react differently in regard to this characteristic of pumping out oil entrained in the refrigerant, and it is known to make modifications to specific designs to enhance the tendency to pump out more oil as the level of oil rises.

However, during the course of operation of a series connected compressor system, such as the heat pump systems of my U.S. Pat. Nos. 5,927,088 and 6,276,148, refrigerant/oil imbalances can occur due to such things as, e.g., defrosting requirements, extreme load changes, etc. These imbalances may lead to unbalancing the oil levels in the two compressors; and this may result in taxing the normal oil balancing tendencies beyond their normal capabilities. Accordingly, it may be desirable to incorporate a specific oil balance system in the series connected compressor system.

SUMMARY OF THE INVENTION

In accordance with the present invention an oil balancing system is incorporated in a series connected compressor system, such as the heat pump system of my U.S. Pat. Nos. 5,927,088 and 6,276,148, wherein each compressor is housed in a hermetic casing and has a low side oil sump. An oil transfer conduit extends from the sump of the first compressor in the system (usually the booster compressor) to the sump of the second compressor (usually the primary compressor). When the first compressor is not operating and the second compressor is operating, the pressure within the casing of the first compressor is slightly higher than the pressure within the casing of the second compressor, so oil will, as desired, flow from the sump of the first compressor to the sump of the second compressor when the oil level in the first sump exceeds the height of the oil transfer conduit. However, when both compressors are operating, the pressure in the shell of the second compressor will be much higher than the pressure in the shell of the first compressor, which could cause undesirable oil and/or flow from the sump of the second compressor to the sump of the first compressor. Accordingly, and most importantly, the oil transfer conduit has a check valve which permits oil flow from the first compressor sump to the second compressor sump, but which prevents oil and/or gas flow from the second compressor sump to the first compressor sump.

DESCRIPTION OF THE PREFERRED EMBODIMENT

The present invention will be described in the context of a boosted sir source heat pump as disclosed in my prior U.S. Pat. Nos. 5,927,088 and 6,276,148. However, it will be understood that the present invention is applicable to any system of compressors in series where the compressors each have low side oil pumps.

Figure 1:
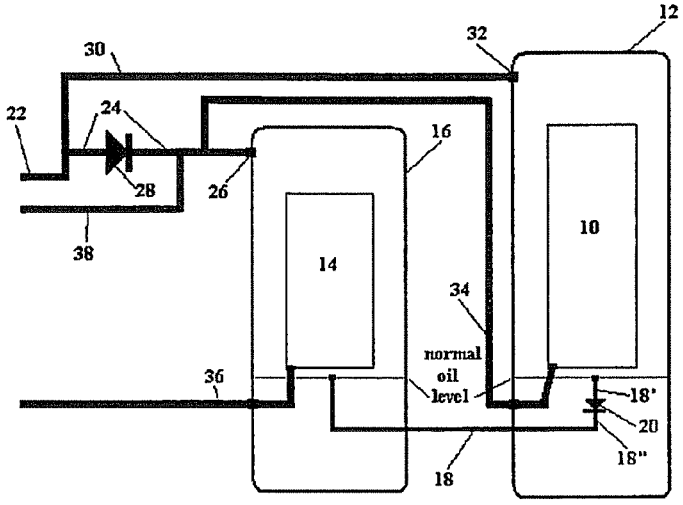
FIG. 1 is a schematic of the oil balance system of the present invention.

Referring to FIG. 1, a booster compressor 10 is housed in a hermetically sealed casing 12, and a primary compressor 14 is housed in a hermetically sealed casing 16. The compressors are preferably reciprocating compressors, but rotary or other types of compressors may be used. Each compressor is a low side sump compressor. That is, the inlet to each compressor is open to the shell of the compressor, and the outlet from each compressor is sealed to the compressor. Each compressor/casing has an oil sump at the bottom of the casing, the normal level of which is shown in shown in FIG. 1. The oil in these sumps is used to lubricate the compressors in ways presently known in the art.

An oil balance conduit 18 extends between the compressor shells at the lower parts thereof. Oil balance conduit 18 is positioned just slightly above the normal level of the sump oil in booster casing 12. A normally open check valve 20 is positioned in oil balance conduit 16. Check valve 20 permits oil flow from the sump of booster casing 12 to the sump of primary casing 16 when primary compressor 14 is on and booster compressor 10 is off or when both compressors are off, but prevents oil flow from the sump of primary casing 16 to the sump of booster casing 12 whenever both compressors are on.

A conduit 22 is connected to the low side of a system (e.g., an evaporator in a heating or cooling system), to receive refrigerant from the system low side. A branch conduit 24 is connected to the inlet 26 to primary compressor casing 16 to deliver refrigerant to the interior volume of casing 16 and to primary compressor 14. A check valve 28 in conduit 24 controls the direction of flow in conduit 24. Check valve 28 is preferably normally open to minimize the pressure drop of the fluid flowing through check valve 28 to primary inlet 26. Another branch conduit 30 connects conduit 22 to the inlet 32 to booster compressor casing 12 to deliver refrigerant to the interior volume of casing 12 and to booster compressor 10.

One end of a booster compressor discharge line 34 is sealed to booster compressor 10, and the other end of discharge line 34 is connected to branch conduit 24 downstream of check valve 28, whereby discharge line 34 delivers the discharge from booster compressor 10 to primary inlet 26 and to the interior volume of primary casing 16 and to primary compressor 14.

One end of a primary compressor discharge line 36 is sealed to primary compressor 14 and the other end of discharge line 34 is connected to the high side of the system (e.g., a condenser in a heating or cooling system).

If the system includes an economizer, a conduit 38 would be connected to conduit 24 downstream of check valve 28.

Figure 2:
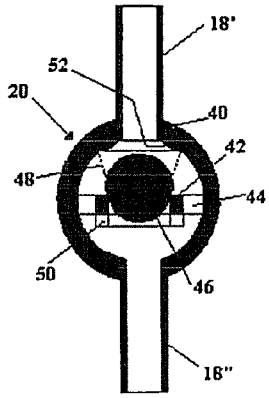
FIG. 2 is a sectional view of the oil balance check valve of FIG. 1.

Normally open check valve 20 may be maintained normally open in any chosen manner. Examples may be understood by reference to FIG. 2 where valve 20 has a spherical chamber 40 in the segments 18' and 18" of oil balance line 18. Chamber 40 is divided into upper and lower segments by a wall 42 which has peripheral flow passages 44. A ball 46 is loaded against wall 42 either by the force of gravity, or by a light spring 48 or by magnets 50. Regardless of the mechanism chosen, valve 20 is normally open to permit flow in line 18 from booster casing 10 to primary casing 16 when the pressure in the interior volume of primary casing 16 is essentially equal to or lower than the pressure in the interior volume of booster casing 12. However, if the pressure in the interior of primary casing 16 is substantially higher than the pressure in the interior volume of booster casing 12, ball 46 will be moved to engage a conical or spherical seat 52 to close the entrance from line 18' to the upper segment of chamber 40, thus blocking flow in oil balance line 18. In the operation of this invention, check valve 20 must be open when primary compressor 14 is on and booster compressor 10 is off, and when both the primary compressor 14 and the booster compressor 10 are off; and check valve 20 must be closed when both the primary compressor and the booster compressor are on.

Normally open check valve 28 may be held normally open in the same manner as valve 20 if it is also mounted vertically. However, if valve 28 is mounted horizontally, spring or magnetic loading will be required.

When both primary compressor 14 and booster compressor 10 are off, the gas pressure in primary shell 16 and in booster shell 12 will be equal. Accordingly, oil flow in balance line 18 will be bidirectional depending on the oil heads in the sumps of the primary and booster shells.

In the heating mode of operation, the booster compressor is off and only the primary compressor is operating at low heating load on the system. In this situation, normally open check valves 20 and 28 are open; and the pressure in booster shell 12 is slightly higher than the pressure in primary shell. Therefore, if the oil level in the sump of booster shell 12 is higher than its intended normal level, which means that the oil level in the sump of primary shell 16 is lower than normal, oil will flow via balance line 18 from the sump of booster shell 12 to the sump of primary shell 16 to restore normal oil levels in both sumps. Also, if the oil level in the sump of primary shell 16 is very high, which means that the oil level in the sump of booster shell 12 is low, and the pressure drop between the sump of booster shell 12 and the sump of primary shell 16 is low enough, oil can flow via balance line 18 from the sump of primary shell 16 to the sump of booster shell 12.

At higher heating loads on the system, both the booster compressor and the primary compressor will be operating. In that situation, the pressure in the primary shell will be higher than the pressure in the booster shell, because the discharge from booster compressor 10 will be delivered via line 34 to casing 16, check valve 28 will be closed, and system low side will be connected via conduits 22 and 30 to the inlet 32 to booster shell 12. Accordingly, normally open check valve 20 will be closed, thus preventing back-flow of compressed gas (which would go from the discharge of booster compressor 10 to primary shell 16 and then back to booster shell 12 via balance line 18 if check valve 20 were open). However, the closure of check valve 20 also prevents oil balance flow via line 18, which can lead to oil imbalance in the sumps of the compressors, particularly creating a concern about low oil level in the sump of primary shell 16.

Some oil becomes entrained in the circulating refrigerant during the operation of the system. When both booster compressor 10 and primary compressor 16 are on, all oil entrained in the refrigerant is delivered to the shell 12 of booster compressor 10, where it tends to separate out and fall into the sump of booster shell 12. If the oil accumulates in the sump of booster shell 12 above the predetermined normal level, operation of the booster compressor will tend to agitate the oil to create a mist that will be entrained in the refrigerant discharged from booster compressor 10. This entrained oil will be delivered to the interior of primary shell 16, where it will tend to drop out from the gas due to differences in gas and oil velocities upon entering into the interior of primary shell 16. This separated oil will fall into the sump of primary shell 16 to replenish the level of oil in this sump.

Since this concern about low oil level in the sump of primary shell 16 occurs only when both the booster and primary compressors are operating, other steps can be taken to address the potential problem in addition to relying on the mist and precipitation action described in the preceding paragraph. One solution is to program the system to turn off the booster compressor for a short time (on the order of 2-4 minutes). As described above for the operational state where the primary compressor is on and the booster is off, this will result in opening normally open valve 20, and any oil built up above normal level in the sump of booster shell 12 will be transferred to the sump of primary shell 16 via transfer line 18.

Also, during defrost cycling and cooling operation, the booster compressor is off, and only the primary compressor is operating. Thus, normally open check valve 20 will be open, and oil balance transfer can take place from the sump of booster shell 12 to the sump of primary shell 16.

While a preferred embodiment of the present invention has been shown and described, various modifications and substitutions may be made thereto without departing from the spirit and scope of the invention. Accordingly, it is to be understood that the present invention has been described by way of illustration and not limitation.

What is claimed is:

1. A compressor system comprising:

a first compressor in a first shell, said first compressor having a first low side lubricant sump;

a second compressor in a second shell, said second compressor having a second low side lubricant sump;

said first and second compressors being connected in series;

a lubricant transfer conduit connected between said first low side lubricant sump of said first compressor and said second low side lubricant sump of said second compressor; and a normally open check valve in said lubricant transfer conduit, said lubricant transfer conduit and said normally open check valve effecting lubricant transfer from one of said low side lubricant sumps to the other of said low side lubricant sumps when lubricant levels in said low side lubricant sumps are out of predetermined balance.

2. A compressor system as in claim 1 wherein:

said normally open check valve permits lubricant flow between both of said low side lubricant sumps when both of said compressors are off.

3. A compressor system as in claim 1 wherein:

said normally open check valve permits lubricant flow from said first low side lubricant sump to said second low side lubricant sump when said first compressor is off and said second compressor is on.

4. A compressor system as in claim 1 wherein:

said compressor system is a heat pump system, said first compressor being a booster compressor and said second compressor being a primary compressor.

5. A compressor system as in claim 1 wherein:

said first shell has a first inlet connected to receive gas from a low side of the system, and said second shell has a second inlet connected to receive gas from a low side of the system, said first compressor has a discharge line connected at one end to said first compressor and connected at the other end to said second inlet of said second shell; and said second compressor has a discharge line connected at one end to said second compressor and at the other end to the high side of the system.

6. A compressor system as in claim 5 wherein:

said normally open check valve permits lubricant flow through said transfer conduit in both directions between said first and second low side lubricant sumps when both of said compressors are off and said normally open check valve permits lubricant flow through said transfer conduit from said first low side lubricant sump to said second low side lubricant sump when said first compressor is off and said second compressor is on.

7. A compressor system as in claim 6 wherein:

said normally open check valve is closed to prevent lubricant flow through said transfer conduit from said second low side lubricant sump to said first low side lubricant sump when both compressors are on.

8. A method for effecting oil balance in a compressor system, including the steps of:

establishing a first compressor in a first shell having a first low side lubricant sump;

establishing a second compressor in a second shell having a second low side lubricant sump;

said first and second compressors being connected in series;

positioning a lubricant transfer conduit between said first low side lubricant sump and said second low side lubricant sump; and positioning a normally open check valve in said lubricant transfer conduit said lubricant transfer conduit and said normally open check valve effecting lubricant transfer from one of said low side lubricant sumps to the other of said low side lubricant sumps when lubricant levels in said low side lubricant sumps are out of predetermined balance.

9. The method of claim 8 wherein:

said normally open check valve permits flow in both directions in said lubricant transfer conduit between said first low side lubricant sump and said second low side lubricant sump when both of said compressors are off.

10. The method of claim 8 wherein:

said normally open check valve permits flow in said lubricant transfer conduit from said first low side lubricant sump to said second low side lubricant sump when said first compressor is off and said second compressor is on.

11. The method of claim 8 including the step of:

closing said normally open check valve to prevent flow in said lubricant transfer conduit when both of said compressors are on.

12. The method of claim 11 including the step of:

stopping the operation of said first compressor to open said check valve to permit flow in said lubricant transfer conduit from said first low side lubricant sump to said second low side lubricant sump.

13. A compressor system as in claim 1 wherein:

said lubricant transfer conduit is connected to each of said first and second shells at approximately the normal level of lubricant in each of said shells.

14. The method of claim 8 wherein:

said lubricant transfer conduit is connected to each of said first and second shells at approximately the normal level of lubricant in each of said shells.

15. A compressor system comprising:

a first compressor in a first shell, said first compressor having a first low side lubricant sump;

a second compressor in a second shell, said second compressor having a second low side lubricant sump;

said first and second compressors being connected in series;

a lubricant transfer conduit connected between said first low side lubricant sump of said first compressor and said second low side lubricant sump of said second compressor; and a normally open flow control valve in said lubricant transfer conduit;

said lubricant transfer conduit and said normally open flow control valve effecting lubricant transfer from one of said low side lubricant sumps to the other of said low side lubricant sumps when lubricant levels in said low side lubricant sumps are out of predetermined balance.

16. A compressor system as in claim 15 wherein:

said normally open flow control valve permits lubricant flow between both of said low side lubricant sumps when both of said compressors are off.

17. A compressor system as in claim 15 wherein:

said normally open flow control valve permits lubricant flow from said first low side lubricant sump to said second low side lubricant sump when said first compressor is off and said second compressor is on.

18. A compressor system as in claim 15 wherein:

said normally open flow control valve is closed to prevent lubricant flow through said lubricant transfer conduit when both of said compressors are on.

19. A compressor system as in claim 15 wherein:

said lubricant transfer conduit is connected to each of said first and second shells at approximately the normal level of lubricant in each of said shells.

* * * * *